US005314191A

United States Patent [19]

Mayas

[11] Patent Number: 5,314,191

[45] Date of Patent: May 24, 1994

[54] WORD FORMING BOARD GAME WITH MIRRORS

[76] Inventor: Marcel B. Mayas, 774 De Mott Ave., Baldwin, N.Y. 11510

[21] Appl. No.: 74,461

[22] Filed: Jun. 10, 1993

[51] Int. Cl.[5] ..... A63F 3/00

[52] U.S. Cl. ..... 273/272; 273/299; 273/280; 273/282.1; 434/159

[58] Field of Search ..... 273/272, 299, 280, 282.1; 434/159, 171, 172, 180, 303, 371

[56] References Cited

U.S. PATENT DOCUMENTS 4,448,423 5/1984 Augusta ..... 273/272

4,923,199 5/1990 Hahn ..... 273/272 X 4,934,711 6/1990 Runstein ..... 273/272

*Primary Examiner*—Vincent Millin

*Assistant Examiner*—William M. Pierce

*Attorney, Agent, or Firm*—Michael I. Kroll

[57] ABSTRACT

A reflective word game is provided in which letter tiles placed into a game plate by a player will simultaneously form both a real word and a reciprocal image word that is reflected in either one or two adjacent mirrors. A challenger player must make up a matching word by placing letter tiles into the game plate which will also be reflected in either one or two adjacent mirrors. The scoring values of the letters making up the words are added up and are cumulative, whereby the player with the highest score at the end of the game is the winner.

14 Claims, 3 Drawing Sheets

| LETTER TILES | FRONT VIEW | BACK VIEW | LETTER TILES | FRONT VIEW | BACK VIEW |
|---|---|---|---|---|---|
| TILE A/a/a | a, a (24) | A | TILE n | n (22) | |
| TILE B/b | B | b | TILE O/o | O | o |
| TILE C | C | | TILE P | P | |
| TILE D/d | D (24) | d | TILE Q/q | Q | q |
| TILE E/e | E | e | TILE r | r | |
| TILE f | f | | TILE S | S (24) | |
| TILE g | g | | TILE T/t | T | t |
| TILE H | H | | TILE U | U | |
| TILE I/i | I (26b, 27) | i | TILE V | V (26A) | |
| TILE J | j | | TILE W | W | |
| TILE K | K | | TILE X | X | |
| TILE L/l | L | l | TILE Y | Y | |
| TILE M | M | | TILE | Z | |

42

TALLY SHEET

| | PLAYERS WORDS | PLAYERS SCORES | CHALLENGERS MATCHING WORDS | CHALLENGERS SCORES | WORDS REFLECTED IN THE RELEVANT MIRROR/S | WORDS MATCHES AND DISCARDED |
|---|---|---|---|---|---|---|
| 1 | bIb | 6 | | | PIP,dId | |
| 2 | MOM | 3 | | | WOW,MOM | |
| 3 | fOE | 3 | | | TOW | |
| 4 | MIIE<br>MILE | | WIRE | 4 | WIIE<br>WIrE | MILE |
| 5 | tOE<br>TOe | | GOT | 11 | fOE<br>gOT | TOe |
| 6 | PEA | | bEg | | bEg | PEa |
| 7 | DEFAUIT | | TAKES Control | | | |
| 8 | PIP | | bIb MATCH AND PLAY | 3 | bIb<br>dId | PIP |
| 9 | fOE | | tOE MATCH<br>TOe AND PLAY | 11 | tOE<br>gOT | fOE |
| 10 | PIP<br>dId | | bIb MATCH AND PLAY | | bIb<br>dId | PIP<br>bIb |
| 11 | fOE<br>gOT | | tOE<br>TOE | | tOE<br>gOT | fOE<br>TOE |
| 12 | PIP<br>dId | 7 | bIb<br>bIb | | bIb<br>dId | PIP<br>bIb |
| 13 | fOE<br>gOT | 11 | tOE<br>TOe | | tOE<br>gOT | fOE<br>TOE |
| | TOTAL | | TOTAL | | | |

52

Fig.8

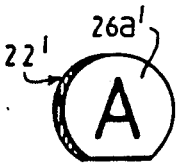

Fig.3a

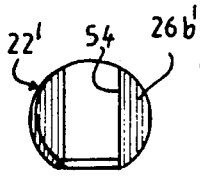

Fig.3b

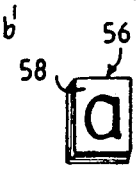

Fig.3c

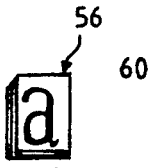

Fig.3d

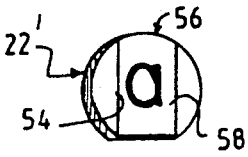

Fig.3e

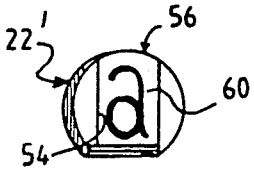

Fig.3f

WORD FORMING BOARD GAME WITH MIRRORS

BACKGROUND OF THE INVENTION

1. Field of the Invention

The instant invention relates generally to word games and more specifically it relates to a reflective word game.

2. Description of the Prior Art

Numerous word games have been provided in prior art that are adapted to utilize a deck of cards with letters printed thereon to form words by combining in combination some of the cards together. While these units may be suitable for the particular purpose to which they address, they would not be as suitable for the purposes of the present invention as heretofore described.

SUMMARY OF THE INVENTION

A primary object of the present invention is to provide a reflective word game that will overcome the shortcomings of the prior art devices.

Another object is to provide a reflective word game that involves the simultaneous formation of both a real word out of letter tiles placed into a game plate and a reciprocal image word that is reflected in two adjacent mirrors.

An additional object is to provide a reflective word game in which the word reflected in the mirrors may be different from that formed on the game plate, so that scoring values of the letters making up the word are added up and are cumulative in which the player with the highest score at the end of the game is the winner.

A further object is to provide a reflective word game that is simple and easy to use.

A still further object is to provide a reflective word game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 3*a* is a perspective view of a first face of a modified triple graphic letter tile with an upper case letter "A" thereon.

FIG. 3*b* is a perspective view of a second face of the modified triple graphic letter tile having a slot thereacross.

FIG. 3*c* is a perspective view of a first side of an insert with a lower case letter "a" thereon.

FIG. 3*d* is a perspective view of a second side of the insert with a lower case letter "a" thereon.

FIG. 3*e* is a perspective view of the second face of the modified triple graphic letter tile with the insert inserted within the slot with the first side showing.

FIG. 3*f* is a perspective view similar to FIG. 3*e* with the second side of the insert showing.

Figure 4A:
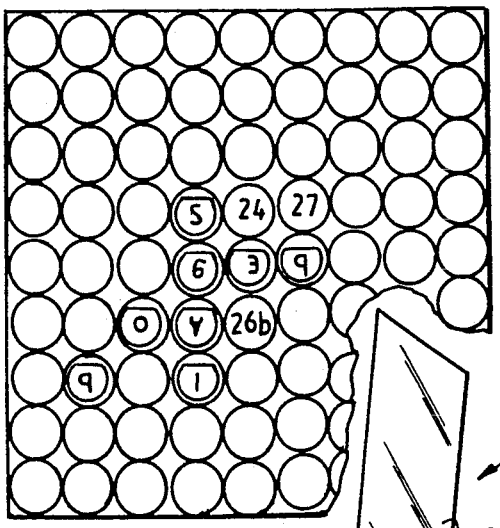

FIG. 4*a* is a plan view with parts broken away of the first game platform.

Figure 4B:
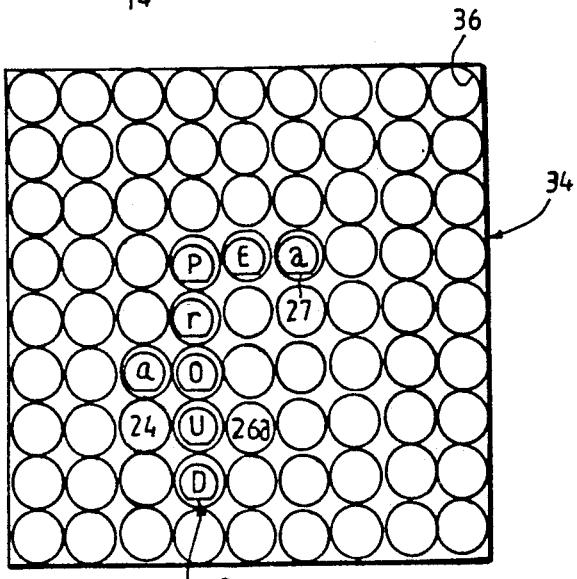

FIG. 4*b* is a plan view of the second game platform.

Figure 5:
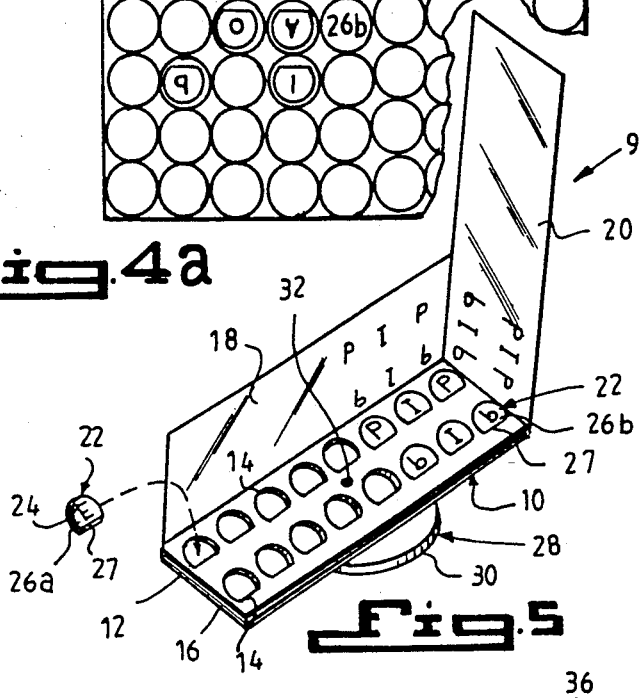

FIG. 5 is a perspective view of the game plate with its attendant mirrors.

Figure 6:
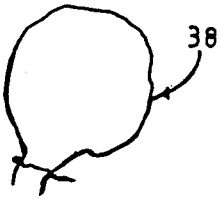

FIG. 6 is a diagrammatic elevational view of the drawstring bag.

Figure 7:
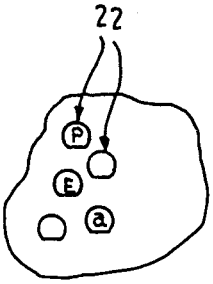

FIG. 7 is plan view showing discarded piles of letter tiles that are formed during the game.

FIG. 8 is a plan view of one of the tally sheets.

DETAILED DESCRIPTION OF THE PREFERRED EMBODIMENTS

Turning now descriptively to the drawings, in which similar reference characters denote similar elements throughout the several views, FIG. 5 illustrates a reflective word game 9, which consists of a rectangular game plate 10 having an upper row 12 of a plurality of recessed grids 14 and a lower row 16 of a plurality of recessed grids 14. A rectangular top mirror 18 is positioned horizontally and extends upwardly along a long side of the rectangular game plate 10. A rectangular side mirror 20 is positioned vertically and extends upwardly along a short side of the rectangular game plate 10 lateral to the both rows 12 and 16 of the plurality of recessed grids 14.

A plurality of tiles 22 are provided with each having at least one letter 24 of an alphabet printed on one face 26*a*. A first player can utilize some of the tiles 22 in constructing a word within the upper row 12 of the plurality of recessed grids 14 in the rectangular game plate 10, to reflect into the rectangular top mirror 18 and/or the rectangular side mirror 20. A second player can utilize some of the tiles 22 in constructing a word within the lower row 16 of the plurality of recessed grids 14 in the rectangular game plate 10 to reflect into the rectangular top mirror 18 and/or the rectangular side mirror 20 to match up with the first word of the first player. An object of the game is for each player to form simultaneously a real word and a reflective word, which the other player does not have in their possession of the letter tiles 22.

Each recessed grid 14 in the upper row 12 and the lower row 16 in the rectangular game plate 10 is truncated circular shaped, while each tile 22 is truncated circular shaped. The truncated side 27 of the tile 22 represents the bottom of the letter 24 thereby allowing for unequivocal identification of the letter 24, if the tile 22 is inverted and to properly position the tiles 22 within the truncated circular shaped recessed grids 14 in the upper row 12 and the lower row 16 in the rectangular game plate 10.

The reflective word game 9 further includes a mechanism 28 for revolving the rectangular game plate 10 to face either one of the two players. The revolving mechanism 28 is a base 30 pivotally mounted at 32 to the center of the rectangular game plate 10 to allow the rectangular game plate 10 to turn with respect to the base 30.

As shown in FIGS. 4*a* and 4*b*, a game platform 34 is provided for each player having a plurality of circular recessed grids 36 for storage of the letter tiles 22 in alphabetical order before the game is played. The game platform 34 after it is emptied can be used for formation of words which will then be placed in the rectangular game plate 10 during the play of the game.

A drawstring bag 38 shown in FIG. 6, is for holding the letter tiles 22 therein, so that each player may randomly draw the letter tiles 22 therefrom during the play of the game.

Figures 1, 2:
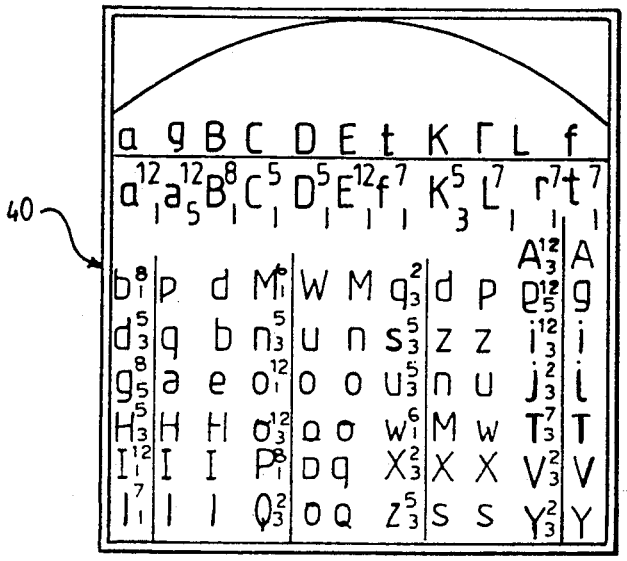
FIG. 1 is a plan view of the information board.
FIG. 2 is a plan view of a chart listing all of the different types of letter tiles used in the game.

FIG. 1 illustrates an information board 40 for each player. The information board 40 shows a game alphabet and its mirror matching letter graphics, with a numeral in an upper right hand corner attending each letter representing the frequency of distribution of the letter and a numeral in a lower right hand corner attending each letter representing a scoring value of the letter. When each information board 40 is erected on top of each game platform 34, it can serve as a barrier to ensure secrecy for the game platform 34 at the beginning of the game. When the information board 40 is placed down it can serve as a lid on the game platform 34, which will be used as a storage box at the end of the game.

A letter tile chart 42 in FIG. 2 illustrates a list of various types of the letter tiles 22 having letters 24 of the game alphabet printed on the faces 26*a* and 26*b*. Some of the letter tiles 22 have a single letter 24, some of the letter tiles 22 have double letters 24 and one of the letter tiles 22 ha triple letters 24 thereon. The single letter 24 on each letter tile 22 can be either an upper case letter or a lower case letter on one face 26*a* thereof. The double letters 24 on each letter tile 22 are an upper case letter on the first face 26*d* and a lower case letter on the second face 26*b* thereof.

A tally sheet 52 shown in FIG. 8 is also provided for each player, which records the word formed by the player, the word reflected in the rectangular top mirror 18 and/or the rectangular side mirror 20, the matching word formed by the challenger player, the word matched/discarded and the scores of the player and the challenger player.

FIGS. 3*a*, 3*b*, 3*e* and 3*f* illustrate a modified triple letter tile 22' which includes the first face 26*a* having an upper case letter "A" thereon and the second face 26*b'* having a slot 54 extending thereacross. An insert 56, shown in FIGS. 3*c*, 3*d*, 3*e* and 3*f*, has a lower case letter "a" on a first side 58 and a lower case "a" on the second side 60. The insert 56 can be inserted within the slot 54 in a first instance with the first side 58 with the lower case letter "a" facing and in a second instance with the second side 60 with the lower case letter "a" facing.

GAME RULES

1. The game is played by two players; however, a player can team up with one or two other players to make a two against two or three against three game, especially when the game involves the use of more than one language.

2. After shuffling the letter tiles in a bag, each player draws twenty seven letter tiles out of a pool of one hundred and sixty two tiles. The game rounds are secret and then open after all the letter tiles have been drawn from the bag.

3. The player whose first draw is nearest to the letter A plays first.

4. Before the game begins the players should agree on the language/languages they will use (e.g. English and/or Spanish and/or French, etc.)

5. The word formed by the player on the game plate should consist of at least two letters and must reflect on at least one mirror a graphically different word within a language or across different languages.

6. The words are read from left to right on the game plate and in the mirror/mirrors. The word/words shown in the mirror is the word to be formed by the challenger in order to match the player's word.

7. A round of play is completed when any of the words formed on the game plate cannot be matched.

8. After each round of play, each player draws one letter tile from the drawstring bag with the matching and/or the scoring player drawing first. Additionally, where possible, the player whose word has been matched and discarded may replenish his platform pool with an equal number of letter tiles drawn from the drawstring bag.

9. The player keeps his turn as long as his words remain unmatched. He loses his turn to the challenger when his word is matched.

10. Unmatched words formed by the player and matching words formed by the challenger are recyclable (the letters can be reused to form new words). Matched words are discarded.

11. A player is not allowed to form the same graphic word more than once.

12. A word which can be mirror matched must be matched (NO DODGING).

13. SUBSTITUTION/UNMASKING: A challenger is allowed to substitute a word formed by the player with the same phonetic word but with different graphics before matching it. In this case the challenger matches and scores.

14. Where mirroring a new word, the matching word or its graphic substitute must be the first word played. To avoid being recalled, the challenger must say "Match and Play" before recycling his matching word.

15. RECALL/ROUTING: Recall refers to a situation where the player calls back into play a matching word which the challenger omits to play either because he doesn't know that his matching word mirrors a new graphic word or because he avoids being matched back by the player. In this case the player matches the challenger's word and scores. (Situations 12 and 13 of the tally sheet).

16. The substituted and/or recalled word is imputable to the word holder, therefore, cannot be formed again by the word holder.

17. SCORING:

a. A player can only score on his turn except: As a challenger, if the word matched has been previously recalled and/or substituted.

b. The score of the word is calculated by adding up the values of the letters forming the word.

c. Only the word formed on the game plate is granted a score.

d. Isographic word (word mirroring a graphically identical word) carries no score in the mirror it self-mirrors. (Situation 2 of the tally sheet).

e. A word reflecting in both mirrors (top and side) two graphically different words scores twice its letter value. (Situation 1 of the tally sheet).

18. A player who fails to form at least one word on his turn after all the letter tiles had been drawn from the drawstring bag is out of the game. He is not allowed to match any of the words subsequently formed by the other player.

19. The game ends when all possible plays have been made.

20. The player whose words total the higher score at the end of the game wins. In case of a tie the player with the lower score of unplayed letters wins.

21. ABOUT WORDS:

a. All words labeled as parts of speech (archaic, colloquial, slang, words of foreign origin and of course, foreign language words, if the players agree to play across different languages) are accepted. Also permitted are words of general knowledge whose publications in magazines, journals, or ads authenticate the correct spelling and definition. Geographical names are also permitted. Abbreviations are not permitted except for those that are officially substantivized (e.g. Iq, gI, Dna) in the game dictionary.

b. People's names only, numerals alone or in combination, street names, suffixes, prefixes standing alone, comb form, and words requiring a hyphen or an apostrophe are not permitted. E.g. PIErrE, capital of South Dakota is acceptable. PIErrE, the guy next door is not acceptable. jonAH, the prophet is acceptable jonAH, the English teacher is not acceptable.

c. The words may be short of diacritics (written accents, common in romance languages). Additionally, however, the players may elect to play "camouflage" which obliges the players to spell out the word with accents.

d. The words may be formed combining script, lower case and upper case letters in any order. On the platform the words may be formed crossword fashion.

22. ABOUT LETTERS:

a. OE , oe is split into 0 and E, or o and e.

b. Letters are assigned different values as posted on the information board.

23. ABOUT PLAYERS:

a. A player must call his/her play by saying the words formed on the game plate and in the mirror/mirrors. A player may be challenged for the spelling of the words formed.

b. It is not required that the player give the definition of the words formed.

c. The burden of proof is on the player who forms the word. After consultation of a dictionary or any official publication, if the spelling of the word proves to be incorrect the player loses the score of the incorrect word formed and his turn. If the word proves to be correct, the challenger loses two points.

* A further illustration of the game rules is shown by the play possibilities embodied in the tally sheet.

1. The player's word bIb mirroring two graphically different words PIP and dId respectively in the top and side mirrors is not matched by the challenger. The player scores twice the letter value of the word bIb ($3\times2=6$).

2. The player's word MOM mirroring one graphically different word WOW in the top mirror and one isographic word (same graphic word) MOM in the side mirror is not matched by the challenger. The player scores the letter value of the word MOM only once (=3) because the word MOM reflects a graphically different word WOW in the top mirror, but an isographic word in the side mirror, therefore carries no score.

3. The player's word foE mirroring a graphically different word toE is not matched by the challenger. The player scores the letter value of the word foE (=3).

4. The player's word MIlE mirrors wIlE in the top mirror. However, the challenger elects to substitute MIlE with MILE which mirrors wIrE in the top mirror and the challenger matches MILE with WIrE. The challenger discards the player's word MILE and he scores the letter value of the word WIrE (=4).

5. The player's word toE mirrors foE in the top mirror. However, the challenger elects to substitute toE with Toe which mirrors goT in the side mirror and the challenger matches Toe with goT. The challenger discards the player's word Toe and he scores the letter value of the word goT (=11).

6. The player's word PEa mirroring bEg in the top mirror is matched by the challenger's word bEg. The challenger discards the player's word PEa he takes control of the game, but he scores no point because it was not his turn.

7. The player cannot form a game word on his turn the challenger takes control of the game.

8. The player's word PIP mirroring bIb in the top mirror is matched by the challenger's word bIb. The challenger discards the player's word PIP. Additionally the challenger realizing that his word bIb mirrors a new word dId in the side mirror calls a play by saying "Match and Play". the challenger's word bib is not matched back. The challenger scores the letter value of the word bIb (=3).

9. The player's word foE mirroring toE in the top mirror is matched by the challenger's word toE. The challenger discards the player's word foE. Additionally, the challenger realizing that the graphic substitute of his word toE—Toe mirrors a new word goT in the side mirror calls a play by saying "Match and Play". The challenger's word Toe is not matched back. The challenger scores the letter value of the word Toe (=11).

10. The player's word PIP mirroring bIb in the top mirror is matched by the challenger's word bIb. The challenger discards the player's word PIP. Additionally, the challenger, realizing that his word bIb mirrors a new word dId in the side mirror calls a play by saying "Match and Play". The challenger's word bIb is matched by the player's word dId. Neither the player nor the challenger scores because both their words were matched on their respective turns.

11. The player's word foE mirroring toE in the top mirror is matched by the challenger's word toE. Additionally, the challenger, realizing that the graphic substitute of his word toE—Toe mirrors a new word goT in the side mirror calls a play by saying "Match and Play". The challenger's word Toe Toe. Neither the player nor the challenger scores because both their words were matched on their respective turns.

12. The player's word PIP mirroring bIb is matched by the challenger's word bIb. The challenger discards the player's word PIP. The challenger recycles his matching word bIb. The player calls back into play (recall) the challenger's matching word bIb which mirrors a new word dId. The player matches the challenger's word bIb with his word dId. The player scores the letter value of his word dId (=7).

13. The player's word foE mirroring toE is matched by the challenger's word toE. The challenger discards the player's word foE. The challenger recycles his matching word toE. The player calls back into play (recall) the challenger's matching word toE which he graphically substitutes with Toe. The word Toe mirrors a new word goT. The player matches the challenger's word Toe with his word goT. The player discards the challenger's matching word Toe. The player scores the letter value of the word goT (=11).

| LIST OF REFERENCE NUMBERS | |
|---|---|
| 9 | reflective word game |
| 10 | rectangular game plate |
| 12 | upper row |
| 14 | recessed grid in 10 |
| 16 | lower row |
| 18 | rectangular top mirror |
| 20 | rectangular side mirror |
| 22 | letter tile |
| 22' | modified triple letter tile |
| 24 | letter on 22 |
| 26a | first face of 22 |
| 26a' | first face of 22' |
| 26b | second face of 22 |
| 26b' | second face of 22' |
| 27 | truncated side of 22 |
| 28 | revolving mechanism |
| 30 | base of 28 |
| 32 | pivot of 28 |
| 34 | game platform |
| 36 | circular recessed grid in 34 |
| 38 | drawstring bag |
| 40 | information board |
| 42 | letter tile chart 42 |
| 52 | tally sheet |
| 54 | slot in 26b' |
| 56 | insert |
| 58 | first side of 56 |
| 60 | second side of 56 |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A reflective word game which comprises:

a) a rectangular game plate having a surface with an upper row of a plurality of recessed grids and a lower row of a plurality of recessed grids;

b) a rectangular top mirror positioned horizontally and extending upwardly above said surface at an angle adjacent to and along a long side of said rectangular game plate; and c) a rectangular side mirror positioned vertically and extending upwardly above said surface at an angle adjacent to and along a short side of said rectangular game plate lateral to said both rows of said plurality of recessed grids.

2. A reflective word game as recited in claim 1, further including a plurality of tiles, each having at least one letter of an alphabet printed on one face, so that a first player can utilize some of said tiles in constructing a word within said upper row of said plurality of recessed grids in said rectangular game plate to reflect into said rectangular top mirror/said rectangular side mirror, while a second player can utilize, some of said tiles in constructing a word within said lower row of said plurality of recessed grids in said rectangular game plate to reflect into said rectangular top mirror/said rectangular side mirror to match up with said first word of said first player, in which an object of said game is for each player to form simultaneously a real word and a reflective word which said other player does not have in their possession of said letter tiles.

3. A reflective word game as recited in claim 2, wherein each said recessed grid in said upper row and said lower row in said rectangular game plate is truncated circular shaped.

4. A reflective word game as recited in claim 3, wherein each said tile is truncated circular shape in which said truncated side of said tile represents the bottom of said letter, thereby allowing for unequivocal identification of said letter if said tile is inverted and to properly position said tiles within said truncated circular shaped recessed grids in said upper row and said lower row in said rectangular game plate.

5. A reflective word game as recited in claim 4, further including means for revolving said rectangular game plate to face either one of said two players.

6. A reflective word game as recited in claim 5, wherein said revolving means is a base pivotally mounted to center of said rectangular game plate to allow said rectangular game plate to turn with respect to said base.

7. A reflective word game as recited in claim 6, further including a game platform for each player having a plurality of circular recessed grids for storage of said letter tiles in alphabetical order before said game is played and said game platform after it is emptied can be used for formation of words which will then be placed in said rectangular game plate during the play of said game.

8. A reflective word game as recited in claim 7, further including a drawstring bag for holding said letter tiles therein, so that each player may randomly draw said letter tiles therefrom during the play of said game.

9. A reflective word game as recited in claim 8, further including an information board for each player, showing a game alphabet and its mirror matching letter graphics, with a numeral in an upper right hand corner attending each said letter representing the frequency of distribution of said letter and a numeral in a lower right hand corner attending each said letter representing a scoring value of said letter, whereby when each said information board is erected on top of each said game platform, it can serve as a barrier to ensure secrecy for said game platform at beginning of said game, while when said information board is placed down it can serve as a lid on said game platform, which will be used as a storage box at the end of said game.

10. A reflective word game as recited in claim 9, further including said letter tiles having letters of said game alphabet printed on said faces, in which some of said letter tiles have a single letter, some of said letter tiles have double letters and one of said letter tiles have triple letter thereon.

11. A reflective word game as recited in claim 10, in which said single letter on each said letter tile can be either an upper case letter/a lower case letter on one said face thereof.

12. A reflective word game as recited in claim 11, in which said double letters on each letter tile are an upper case letter on said first face and a lower case letter on said second face thereof.

13. A reflective word game as recited in claim 12, further including a tally sheet for each player, which records the word formed by said player, the word reflected in said rectangular top mirror and said rectangular side mirror, the matching word formed by said challenger player, the word matched/discarded and the scores of said player and said challenger player.

14. A reflective word game as recited in claim 13, wherein said triple letter tile includes:

a) said first face having an upper case letter "A" thereon;

b) said second face having extending thereacross; and c) an insert having a lower case letter "a" on a first side and a lower case letter "a" on a second side, in which said insert can be inserted within said slot in a first instance with said lower case letter "a" facing and in a second instance with said lower case letter "a" facing.

* * * * *